United States Patent [19]

Stoeckli

[11] Patent Number: 4,934,982

[45] Date of Patent: Jun. 19, 1990

[54] APPARATUS FOR THE INDIVIDUAL SEPARATION OF DISK-SHAPED ITEMS, IN PARTICULAR COINS

[76] Inventor: Rudolf Stoeckli, Gallusstrasse 36, 4600 Olten, Switzerland

[21] Appl. No.: 201,914

[22] Filed: Jun. 3, 1988

[30] Foreign Application Priority Data

Jun. 3, 1987 [CH] Switzerland ..... 02101/87

[51] Int. Cl.[5] ..... G07D 1/00

[52] U.S. Cl. ..... 453/56; 453/57

[58] Field of Search ..... 453/6, 7, 10, 11, 30, 453/29, 32, 40, 49, 56, 57

[56] References Cited

U.S. PATENT DOCUMENTS

| | | | |
|---|---|---|---|
| 2,704,144 | 3/1955 | Rety et al. | 221/182 |
| 3,253,604 | 5/1966 | Read | 453/57 |
| 3,726,290 | 4/1973 | Zimmermann | 453/11 |
| 4,441,516 | 4/1984 | Stadler et al. | 453/56 X |
| 4,474,197 | 10/1984 | Kinoshita et al. | 453/57 |

FOREIGN PATENT DOCUMENTS

| | | |
|---|---|---|
| 2754792 | 6/1978 | Fed. Rep. of Germany . |
| 2902648 | 7/1979 | Fed. Rep. of Germany . |
| 2838746 | 3/1980 | Fed. Rep. of Germany . |
| 2902716 | 7/1980 | Fed. Rep. of Germany . |
| 2335006 | 7/1977 | France . |

*Primary Examiner*—F. J. Bartuska

*Attorney, Agent, or Firm*—Hill, Van Santen, Steadman & Simpson

[57] ABSTRACT

Coins lying on a driven rotary plate are displaced by centrifugal force into a discharge channel limiting a permissible thickness of the coins by its height. At a roll-off lug, the coins fed from the discharge channel are rolled off in an S-shaped movement during handling by a conveyor belt acting from above, and are finally conveyed away in a straight direction. The S-shaped movement is forced on the coins by an arrangement of elements which limits an outlet opening. Such an arrangement has the effect of ensuring a reliable and troublefree individual separation of the coins with few moving parts.

21 Claims, 4 Drawing Sheets

Fig. 10
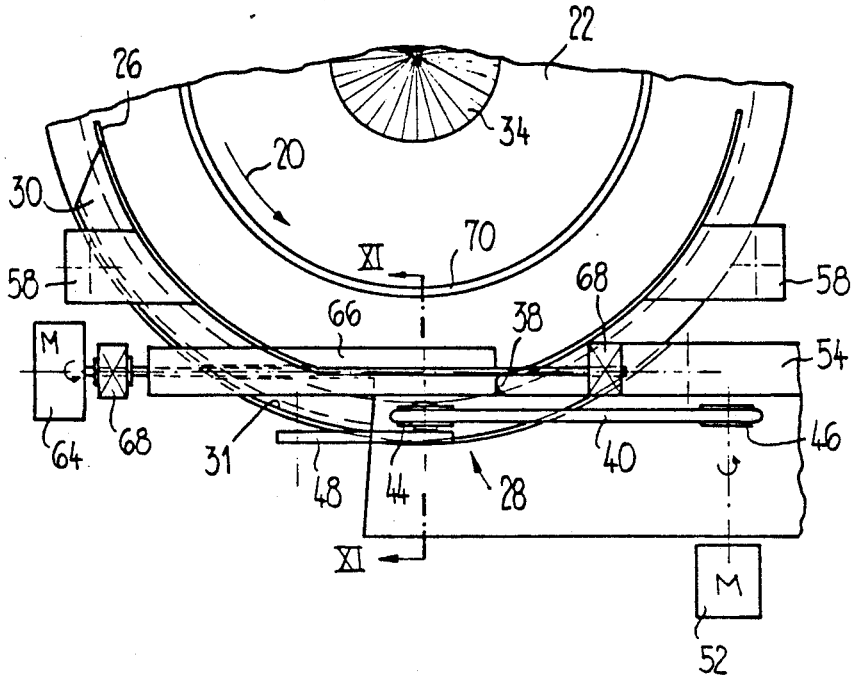
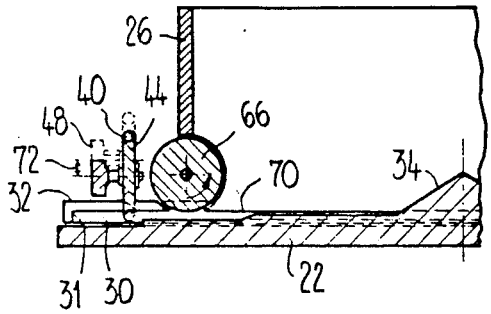
Fig.11

APPARATUS FOR THE INDIVIDUAL SEPARATION OF DISK-SHAPED ITEMS, IN PARTICULAR COINS

BACKGROUND OF THE INVENTION

The invention relates to an apparatus for individual separation of disk-shaped items.

Such an apparatus as a rule has the objective of individually separating the disk-shaped items, in particular items of different sizes and which are delivered as a mass, in such a way that they can be sorted, counted, and/or also stacked and packed in a following apparatus. Apart from coins, these items may, for example, also be washers or other disk-shaped parts which can be produced by automatic machines. Although such items are round as a rule, polygonal disk-shaped items are also covered by this concept, such as for example octagonal coins.

In the case of an apparatus known from DE-Al 29 02 648 incorporated herein, the coins fed on a rotary plate are drawn off the rotary plate by a conveyor belt acting from above at an outwardly directed angle with respect to a tangent from a discharge channel arranged on the circumferential track and which is limited in height. The height limitation of the discharge channel and the conveyor belt pushing the coins on a fixed underlying surface contribute to individual separation. The height limitation is adapted to the thickest coin to be considered. The passage width of the outlet opening must be smaller than twice the diameter of the smallest coin to be handled in order that two coins cannot pass through next to each other. For adaptation to the coin size of various currencies, the width must be variable.

If it is necessary in this case also to individually separate coins of which two of the thinnest, one on top of the other, are not thicker than the thickest coin, an individual separation by the height limitation is not possible. If such coins then also lie congruently one on top of the other, the conveyor belt, acting in fact only on the upper coin, also cannot ensure individual separation since the fixed underlying surface, which as a rule is a laterally limited channel, generally has good sliding properties to achieve a high output. This is also true due to the constant rubbing effects. Thus, such a coin pair passes through the individual separation apparatus without separation.

A further possibility for malfunctions is that coins jam or become wedged at constricted points, such as for example at the outlet opening between the discharge channel and the point of application of the conveyor belt. To remedy such malfunctions, known individual separating apparatuses have manually releasable operating elements. Although such malfunctions can be rectified in this way, the operation in progress is temporarily interrupted and the cost-effectiveness of the individual separating apparatus is impaired.

Another individual separating apparatus, known from DE-Al 27 54 792, has, for a height limitation, a roll positioned ahead of the outlet opening and rotatingly driven in such a way that the upper coins of those coins lying one on top of the other are intended to be repelled in the direction of the center of the plate. However, since the roll has to allow the thickest coin arriving for individual separation to pass, its distance from the rotary plate must be just as large as the already mentioned fixed height limitation. Thus, it is also possible in this case for two thin coins, lying one on top of the other, to pass through the gap underneath this roll.

SUMMARY OF THE INVENTION

It is an object of the invention to create an apparatus of the type mentioned at the beginning which, with high output, individually separates, without malfunctions, disk-shaped items of different sizes without adaptation to the respective size range.

According to the invention, a drivable rotary plate has a fixed guide ring surrounding a central region where disk-shaped items are deposited. An outlet opening is provided at which the items can move outwardly of the guide ring. A discharge channel is arranged in conjunction with the guide ring and ahead of the outlet opening relative to a direction of rotation of the plate. Conveying means extends into a region of the outlet opening for acting from above on items delivered to the outlet opening in order to convey the delivered items through and away from the outlet opening along a guide means. The outlet opening is limited by an outer limiting element and an inner limiting element, a distance between the outer and inner limiting elements defining a passage width at least as large as the diameter of the largest of the items intended for individual separation. The conveying means has a conveying direction extending substantially tangential to the discharge channel. The inner limiting element is arranged radially offset in relation to the outer limiting element such that a clear width corresponding to this offset when viewed in the conveying direction is smaller than said passage width.

The capability of the apparatus according to the invention to individually separate within a large diameter range makes it possible, for example, also to include in the individual separation of all coins of a given currency foreign coins as well which are larger than the largest coins of the given currency. By this means, none of the coins blocking the outlet opening are held back. The segregation of foreign coins takes place in a downstream sorting apparatus. On the other hand, however, coins of only a single size can also be individually separated in order to feed them to a following packing station.

The action of the apparatus according to the invention is based essentially on the fact that, due to the relative arrangement of the outlet opening to the conveyor belt between the discharge channel and the conveying line of the conveying member, a transverse movement corresponding to an S curve is forcibly imparted to the disk-shaped items—coins in the exemplary embodiments described below—by rolling around the inner limiting element. The rolling movement together with the following acceleration by the conveying member ensures that coins lying one on top of the other are reliably separated from each other. The conveying member accelerates the directly contacted coin at a higher rate than the coin moving with it. Other determining factors in reliable individual separation are that the coins are slowed at the inner limiting element, forced into an evasive movement, and subsequently reaccelerated.

The conveying member contacts all coins arriving at the outlet opening through the discharge channel. If, however, a coin meets the conveying member essentially radially with respect to the rotary plate, it rebounds from it to remain on the rotary plate for a further revolution.

The designated conveying member is to be understood in the above context as, for example, a rubber-coated conveying roller or a belt-like endless conveyor belt of any cross-section.

While the passage width of the outlet opening defined by the mutual spacing of the two limiting elements may also be larger than the largest coin intended for individual separation, in order to allow passage also of unknown, even larger foreign coins, the clear width is dependent on how far these two limiting elements are arranged offset from each other with respect to the longitudinal direction of the conveying member. The choice of the clear width can determine which smallest diameter coins are to be rolled off at the inner limiting element. In that case, it is ensured that for coins for which a preliminary individual separation occurs, they do not reach the outlet opening one on top of the other and can be excluded from the rolling movement.

If, however, all coins intended for individual separation are to be rolled off at the inner limiting element, according to a preferred embodiment the clear width must be chosen smaller than the diameter of the smallest coin intended for individual separation.

Of the coins intended for individual separation, the smallest may be even smaller in its diameter than half the size of the largest. The arrangement of the conveying member with respect to the outlet opening also ensures that a bridging by two coins lying next to each other, which in the case of known apparatuses can block the outlet opening, is impossible since, due to the conveying direction of the conveying member, two coins cannot be drawn into the outlet opening in the way which is possible if the conveying direction of the conveying member is at right angles to the clear width of the passage opening.

According to a preferred embodiment of the invention, it is advantageous to drive the conveying member at a speed which is greater than the circumferential speed of the rotary plate, so that the conveying rate of the conveying member reliably prevents a jam at the outlet opening. As a result, a free space is created and it is effectively prevented that coins jam or become wedged against each other at the constricted point of the outlet opening.

Of the elements limiting the outlet opening in its width, if the inner element is designed as a roll-off lug, a rolling effect is produced not only in the direction of the track of the conveying member, but also back onto the rotary plate. Thus, coins repelled from the outlet opening cannot be stopped against an obstacle after their repulsion.

According to a further preferred embodiment, the discharge channel may begin with an outwardly directed step and can be adapted in height to the thickest coin to be individually separated. Thus, a preliminary individual separation occurs due to the height limitation and also due to the step when the coins pass over the step into the discharge channel due to the centrifugal force of the rotating rotary plate.

If the coins of smallest diameter are at the same time the thickest, the preliminary individual separation already ensures that no two of these coins, lying one on top of the other, reach the outlet opening. Thus, such coins can be ignored when determining the clear width, as already mentioned.

Further assistance for the individual separating effect is possible by a peripheral graduation of the rotary plate in the region of the discharge channel, so that the coins passing into the discharge channel tip up as a result of this graduation and thereby prevent, with their upwardly pointing side, a further coin from pushing over, if in fact such thin coins are involved of which two, one on top of the other, fit into the discharge channel in spite of the height limitation. Also, such a graduation can have the effect that if there are already two coins, one on top of the other, a tilting occurs such that the upper coin brushes against the fixed height limitation of the discharge channel and is consequently slowed relative to the lower coin, and is thus displaced on the latter. Such a situation is possible whenever the thickest coin is thicker than two of the thinnest coins.

A covering of the region of the outlet opening by a web which is connected to the guide ring prevents the coins fed in uncontrolled fashion in the center of the rotary plate from hindering the movement necessary through the outlet opening. In particular, it is thus intended to avoid an excessive pressure due to coins lying one on top of the other in the region of the outlet opening. In the case of a conveyor belt as a conveying member, the first deflection roller in the conveying direction should act on the coins to be conveyed directly at the outlet opening above the rotary plate.

An elevation at the center of the rotary plate prevents coins staying at the point at which the centrifugal force is virtually zero. The elevation may, for example, be conical or spherical.

A roll, serving to limit the height of the discharge channel and driven on its underside toward the center of the rotary plate, serves first for fanning. This fanning insures that coins on top of one another in double fashion are not automatically returned to the cycle, but are only slightly shifted with respect to one another and are fed to the conveying member. Secondly, such a roll serves to create a free space on the delivery side of the roll in order to make it possible to reintroduce without friction missed coins and thus to prevent stoppages in the circulation due to the insertion process. Such a roll is particularly expedient whenever the rotary plate has a step at its rim on which the coins tip up, since in such a case the roll can act on the upwardly pointing sides of coins lying one on top of each other and can fan them out for individual separation.

The arrangement of a second guide ring, according to a preferred embodiment, allows a higher operating speed to be attained. The function of the first, or inner, guide ring corresponds to the single guide ring mentioned above. Due to the increased operating speed, the individual separation is not yet completed after the inner guide ring. The high circumferential speed of the rotary plate in relation to the stationary second, or outer guide ring has the effect that the coins turn and, as a result, the upper coins not yet completely individually separated are thrown off, since the circumference of the second, outer guide ring is greater than the circumference of the inner guide ring, space is created for these previously not yet completely individually separated coins. After the second guide ring, the coins leave the rotary plate either by centrifugal force or by means of a further conveyor belt.

BRIEF DESCRIPTION OF THE DRAWINGS

FIG. 10 shows an apparatus similar to that according to FIG. 1, but additionally with a roll for fanning-out the coins;

FIG. 11 shows a sectional view along the line XI—XI of FIG. 10;

DESCRIPTION OF THE PREFERRED EMBODIMENTS

Figure 1:
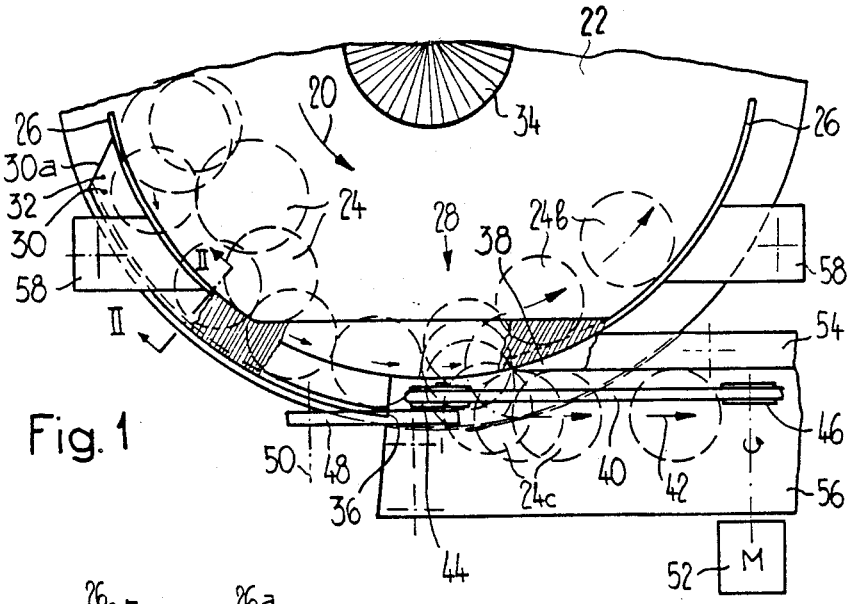
FIG. 1 shows a partial plan view of an apparatus for the individual separation of disk-shaped items, in particular coins.
Figure 2:
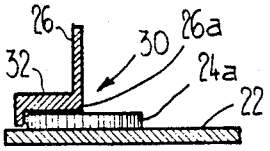
FIG. 2 shows a sectional view along the line II—II of FIG. 1.

The apparatus shown in FIG. 1 has a rotary plate 22 which is driven in the direction of arrow 20 and on which there are coins 24 of various denominations. Above the rotary plate there is a fixed guide ring 26, which is interrupted in the region of a coin outlet opening 28. Ahead of the outlet opening 28 with respect to the direction of rotation 20 of the rotary plate 22, there is a coin discharge channel 30, the cross-section of which is shown in FIG. 2. The discharge channel 30 has a greater radius with respect to the rotary plate 22 than the guide ring 26, and is limited in its height by a cover 32. The clear height of the discharge channel 30 above the rotary plate 22 is dimensioned in such a way that the thickest coin to be considered still passes through. This may be a coin of the intended currency or a foreign coin.

The coins 24 to be individually separated are fed from above through a feed opening (not shown), for example through a funnel, approximately in the center of the rotary plate 22. In order that no coin stays at the center of the rotary plate 22, the latter has in its center an elevation 34, which may for example be conical or spherical. The radial conveyance of the coins 24 into the discharge channel 30 takes place owing to the centrifugal force exerted on the coins 24 during the rotary movement of the rotary plate 22.

The outlet opening 28 is limited on the one hand by the rear edge 36 of the discharge channel 30 and on the other hand by a roll-off lug 38. These limiting elements 36 and 38 are arranged mutually offset in the longitudinal direction of a conveyor belt 40 in such a way that the clear width of the outlet opening 28, with respect to the longitudinal direction of the conveyor belt 40, is preferably smaller than the diameter of the smallest coin to be individually separated, but is large enough, with respect to the direction of passage, to allow a coin of the largest permissible diameter to pass through and be thus individually separated. Such an arrangement of the elements 36 and 38 limiting the outlet opening 28 has the effect that the coins are deflected at the roll-off lug 38 from the discharge channel 30 in approximate correspondence with an S-curve when they are contacted by the conveyor belt 40, the lower side 40*a* of which (FIGS. 3*a*, 3*b*) runs in the conveying direction 42. Coins not yet lying in the discharge channel 30 on the rotary plate 22 are deflected inward at the roll-off lug 38 by the rotary movement of the rotary plate 22 in the direction of arrow 20, so that they remain on the rotary plate 22 for at least one further revolution, as for example the coins 24*b*.

The conveyor belt 40 running above the rotary plate 22 passes around two deflection rollers 44 and 46, of which the first deflection roller 44 is mounted on an arm 48, pivotal about an axis 50 and spring-loaded in the direction of the rotary plate 22. The conveyor belt 40 is driven by a motor 52 connected to the second deflection roller 46 at a speed which is greater than the circumferential speed of the rotary plate 22 driven by a motor (not shown). The first deflection roller 44 is in this case arranged above the outlet opening 28 in such a way that no coins can leave the discharge channel 30 without being handled by the conveyor belt 40.

As can be seen from FIG. 1 by a plurality of indicated coins 24*c*, the coins are drawn around the roll-off lug 38 from the conveyor belt 40, and are subsequently conveyed in the direction 42 along a guide rail 54 on a guide plate 56 to a sorting apparatus (not shown).

The fixed guide ring 26 is fastened by means of brackets 58 on a frame (not shown) of the apparatus. A cover 60, guarding the outlet opening 28 against an accumulation of coins, is connected to the guide ring 26.

FIG. 2 shows, as already mentioned, the coin discharge channel 30 in a cross-section along the line II—II in FIG. 1. The height-limiting effect of the discharge channel 30 can be seen in particular from FIG. 2.

Figure 3A:
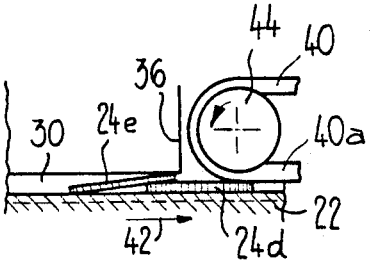
FIGS. 3*a*, 3*b* show the handling of fan-fed coins by a circulatingly driven conveyor belt.
Figure 3B:
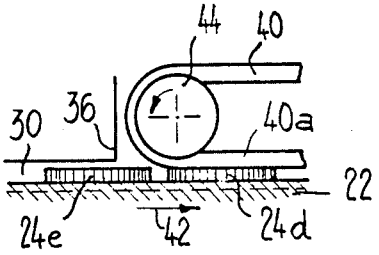

In FIG. 3*a* it is shown how a first coin 24*d* of an overlapping coin pair 24*e*/24*d* is taken up by the lower side 40*a* of the conveyor belt 40 and individually separated as shown in FIG. 3*b*, the lower coin 24*d* under the upper coin 24*e* being drawn ahead by an accelerated conveying away. The second coin 24*e* is still on the rotary plate 22 by which it is fed, and follows the first coin 24*d* to the lower side 40*a* of the conveyor belt 40. A situation wherein two coins are on top of one another in the discharge channel 30 cannot occur when these two coins together are not thicker than the thickest coin 24*a* intended for individual separation, as shown in FIG. 2.

The coins 24*c* shown in FIG. 1 one on top of the other in the region of the outlet opening 28 are merely intended to indicate in which direction the coins are moved in the outlet opening 28. This representation does not mean that the coins lie one on top of the other at this point since a preliminary individual separation already takes place in the discharge channel 30 and a definitive individual separation takes place at the latest when they are taken up by the conveyor belt 40 as shown in FIGS. 3*a* and 3*b*.

Figure 4:
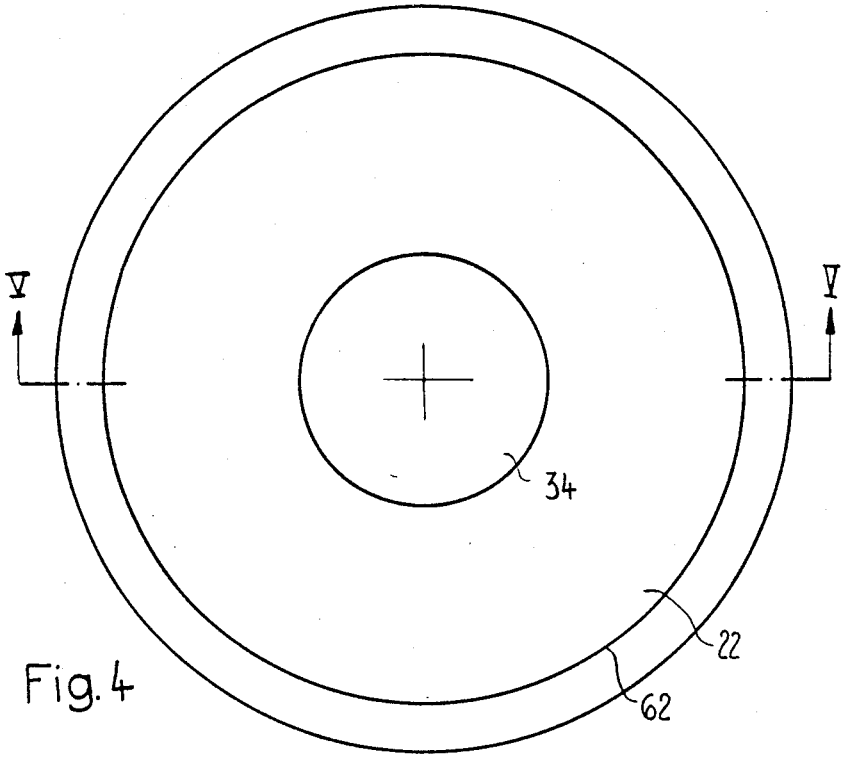
FIG. 4 shows a plan view of the rotary plate.
Figure 5:
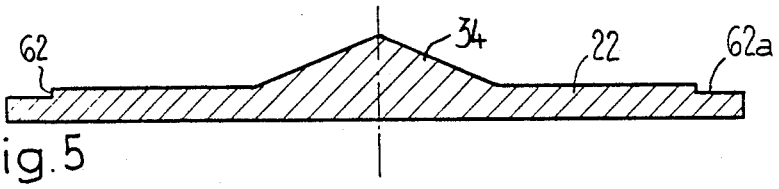
FIG. 5 shows a sectional view along the line V—V of FIG. 4.

FIG. 4 shows the rotary plate 22 in a plan view and FIG. 5 shows a sectional view along the line V—V of FIG. 4. Unlike the rotary plate 22 shown in FIG. 1, the rotary plate shown in FIGS. 4 and 5 has at its periphery a step 62.

Figure 6:
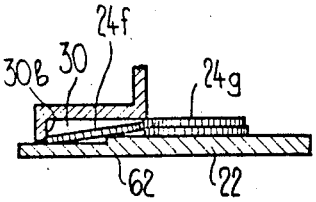
FIG. 6 shows coins in the discharge channel on a rotary plate with a step.

According to FIG. 6, the step 62 is at a certain distance away from the guide surface 30*b* of the discharge channel 30 such that at least the smaller and medium-sized coins, which are usually also the thinner ones and can enter the discharge channel 30 on top of one another in a wide variety of ways, tip up in an outward fashion. In FIG. 6, such a tipped-up coin 24*f* is shown, which illustrates that it is not possible for a following coin 24*g* of a pair of coins, one on top of the other, to push itself over the tipped-up coin 24*f*, since the latter bars its way.

Figure 7:
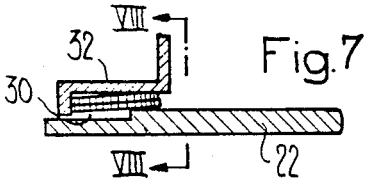
FIG. 7 shows coins arriving stacked in the discharge channel.
Figure 8A:
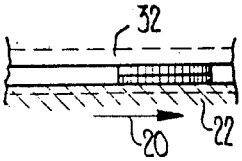
FIG. 8*a* shows a sectional view along the line VIII—VIII of FIG. 7.
Figure 8B:
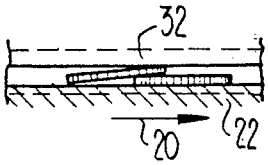
FIG. 8*b* shows a breaking-up of the stack according to FIG. 8*a;*

FIG. 7 shows a situation in which two coins, one on top of the other, have reached the discharge channel 30. The tipping effect brushes the upper of the two coins against the inner limiting surface of the cover 32 of the discharge channel 30, so that it is slowed relative to the lower coin and is brushed off of it. To increase this effect, the inner limiting surface of the cover 32 may be roughened. According to FIG. 1, this limiting surface is continued in the region of the outlet opening 28 by the web 60, which may likewise be roughened on its underside. FIGS. 8*a* and 8*b* show the operation described with respect to FIG. 7 in a side view along the line of intersection VIII—VIII according to FIG. 7. The arrow 20 denotes the direction of rotation of the rotary plate 22.

Figure 9A:
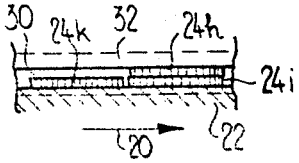
FIG. 9*a* shows coins arriving in stacked fashion.
Figure 9B:
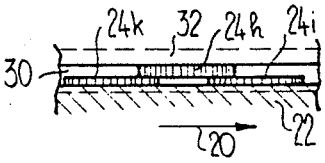
FIG. 9*b* shows breaking-up of the stack according to FIG. 9*a;*

FIGS. 9*a* and 9*b* show, in an identical view to FIGS. 8*a* and 8*b*, a situation with a coin 24*k* following the coins 24*h* and 24*i*, which lie one on top of the other. As the upper coin 24*h* cannot now be brushed off directly, bridging takes place in accordance with FIG. 9*b*.

If the first coin 24*i* then reaches the take-up region of the conveyor belt 40, a break-up takes place in accordance with FIGS. 3*a* and 3*b*.

If a set of two coins lying completely congruently one on top of the other (for example relatively large coins which do not tilt) are taken up by the conveyor belt 40, the slight forward tilting movement, which is produced by the coins being pushed forward under the pressure of the guide roller 44 (FIGS. 3*a* and 3*b*) into the cavity of the step 62, has the effect of fanning the upper coin forward to such an extent that it first meets the roll-off lug 38 (FIG. 1) and, due to the suddenly occurring lateral rolling movement, is abruptly rolled down off the lower coin.

The embodiment shown in FIG. 10 differs from the embodiment shown in FIG. 1 in the arrangement of a driven roll 66. This roll 66, mounted in two bearings 68 above the rotary plate 22, rotates on its underside in the direction of the center of the plate. A second motor 64, or else the first motor 52, may serve as a drive by means of a gear.

The roll 66 has essentially three functions: first, a fanning-out of coins lying one on top of the other in the region spanning the discharge channel 30 which has the effect of a height limitation, similar to FIGS. 7, 8*b* and 9*b*; second, a shoveling away of the coins toward the center of the plate to keep the outlet opening 28 clear wherein at least some of the coins stay inclined on the step 70; and third, a creation of a free space in the region of the coins deflected inwardly by the roll-off lug 38. Coins conveyed inwardly by the roll 66 again first reach the rim formed by the guide ring 26 in the region after the roll-off lug 38. The height of the roll 66 above the rotary plate 22 is preferably variable.

Thin coins, possibly stacked in double fashion on top of one another in the discharge channel 30, are fanned and not returned into the collection of coins.

Optimum feeding of the coins into the coin channel depends greatly on a troublefree circulation of the collection of coins. Since no stoppages can occur at the outlet due to the forced accelerated delivery of the coins by the conveyor belt 40, it still has to be taken into consideration that sufficient space for the reinsertion of coins running right at the outside but not handled by the conveyor belt 40 is created. In order to greatly increase this effect, which is partly produced by the inwardly acting surface of the roll 66, the rotary plate 22 may have the step 70 (see also FIG. 11) with an obliquely inclined surface, which also raises thin coins of the coin collection such that they are taken up by the roll 66 and moved inwardly and upwardly (wedge effect), so that additional free space is produced for the reinsertion of missed coins.

Compared with known devices, the roll 66 serves for fanning-out coins lying one on top of the other which are not being forced to return into the circulation but are fed to the conveyor belt 40 only slightly shifted with respect to each other. Secondly, this creates a free space on the delivery side of the roll 66 which allows a smooth reinsertion of missed coins, and in this way prevents stoppages in the circulation by the insertion process. The measures and characteristics described above in conjunction with the arrangement with the roll 66 have the effect of achieving a high operating efficiency of the described apparatus.

The radially outer limiting surface 31 of the discharge channel 30 may be designed vertically, or else slightly inclined or stepped in order to make possible an easy lateral fanning of the coins to effectively prevent coins of the same size from remaining exactly one on top of the other.

It is indicated in FIG. 11 that the spring-loaded arm 48 has a swiveling range 72 which is sufficient to convey satisfactorily all thicknesses of the coins to be individually separated.

As is evident from FIG. 10, the roll 66 is arranged in such a way that it is juxtaposed 28 tangentially with respect to the rotary plate 32 ahead of the outlet opening. All coins passing through the outlet opening 28 must go underneath the roll 66.

As can be seen from FIG. 11, the discharge channel 30 has a cover 32 for its height limitation, just like that shown in FIG. 1.

Figure 12:
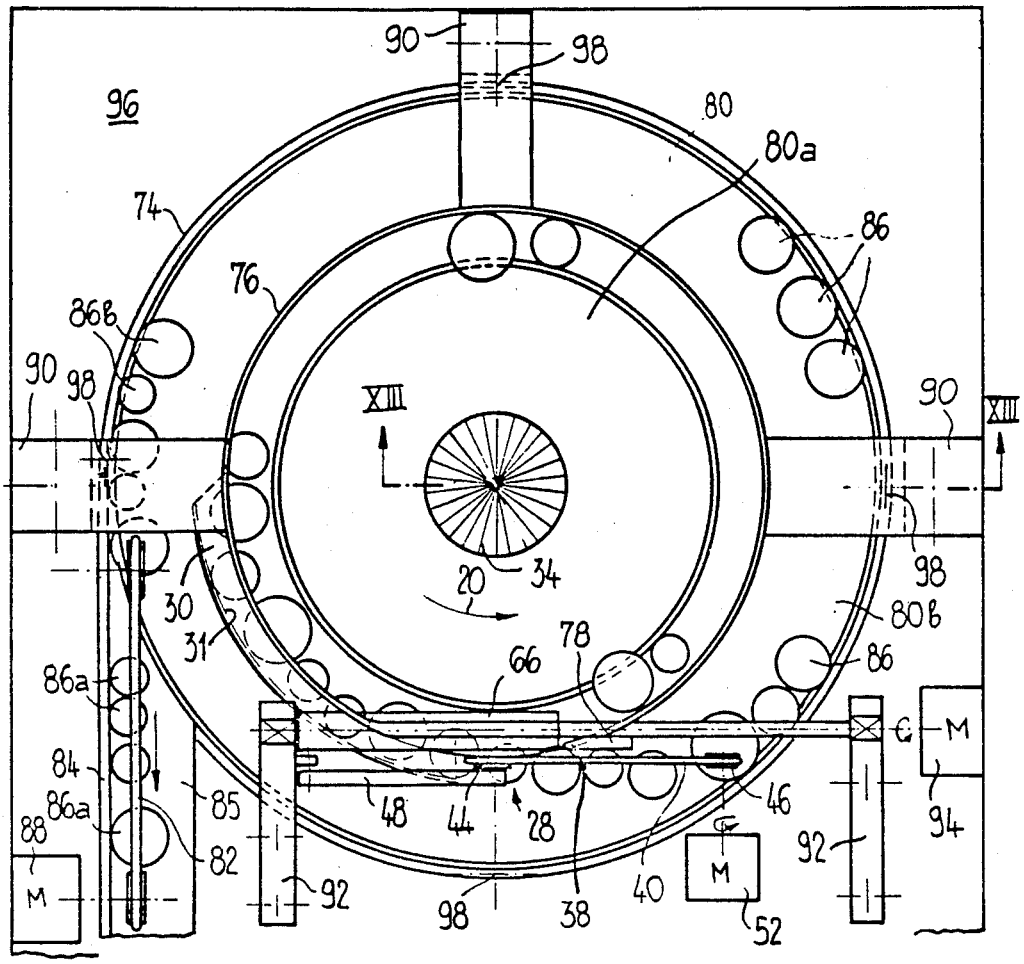
FIG. 12 shows an apparatus with two fixed rings above the rotary plate for staged individual separation.

FIG. 12 shows an embodiment with two mutually concentrically arranged fixed guide rings 74 and 76, of which the inner guide ring 76 essentially corresponds to the single guide ring 26 shown in FIGS. 1 and 10. The inner guide ring 76 is assigned, in the same arrangement as the guide ring 26 shown in FIG. 10, a conveyor belt 40 and a roll 66. The discharge channel 30, the outlet opening 28, and the roll-off lug 38 also correspond to the embodiment according to FIG. 10. Instead of the guide rail 54 running parallel to the conveyor belt 40 in FIGS. 1 and 10, the embodiment according to FIG. 12 only has a short guide rail 78. The rotary plate 80, which can be driven in the direction of arrow 20, has an inner region 80*a* and an outer region 80*b*, and corresponds in its diameter to the outer guide ring 74.

Within the inner guide ring 76 on the inner region 80*a* the collection of coins is individually separated. The individual separation takes place as already described, but the coins are not only conveyed away linearly along the guide rail 78, but are brought to the outer region 80*b* where they are once again accelerated. This produces sizable intervals between the individual coins 86, so that the quantity of coins fed, and thus the output of the conveyor belt, can be increased. The definitive individual separation does not take place until the coins lie along the outer ring 74. Consequently, the conveyor belt 40 can be fed more coins and at greater speed, for example by greater plate speed. Due to this technique, it is no longer possible for the conveyor belt 40, in spite of the simultaneous increase in its speed, to individually separate the large quantity of coins completely since the acceleration is no longer sufficient to create sufficient space for the individual separation. This space is produced, however, by acceleration on the outer region 80*b* of the rotary plate 80.

The transport away from the outer region 80*b* may take place by centrifugal force alone or in a forcible fashion, for example by a second conveyor belt 82, the speed of which is adapted to the speed of the coins being fed.

The second conveyor belt 82 is assigned a second guide rail 84, which extends tangentially with respect to the outer guide ring 74 and along which the individually separated coins 86*a* are conveyed on a guide plate 85 to a following apparatus (not shown), for example a sorting and counting apparatus. A further motor 88 serves to drive the second conveyor belt 82.

Three radially extending brackets 90, which project beyond the outer guide ring 74, serve to fasten the fixed inner guide ring 76. The roll 66 is mounted at both ends by means of supports 92, and is driven by means of a third motor 94.

The apparatus described in FIG. 12 is set up on a machine baseplate 96, on which the outer guide ring 74 is fastened at fastening points 98. The other reference symbols used in FIG. 12 correspond to the explanations concerning FIGS. 1 and 10.

Figure 13:
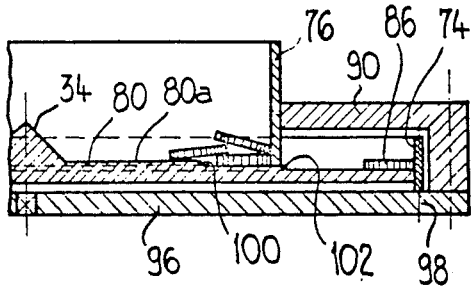
FIG. 13 shows a sectional view along the line XIII—XIII of FIG. 12.

FIG. 13 shows a sectional view along the line of intersection XIII—XIII according to FIG. 12. In particular, it can be seen from this figure that the rotary plate 80 has at a certain distance from the inner guide ring 76 a beveled step 100, and a second step 102 flush with the inner guide ring 76. The beveled step 100 corresponds to the step 70 in the embodiment according to FIG. 10. The step 102 corresponds approximately to the step 62 according to FIGS. 4 to 7.

An individual separation apparatus must also be capable of being stopped when the container formed by the rotary plate and the inner guide ring is not yet empty, for example when changing a full container for an empty one, and receiving the sorted coins. The coins 86*b* are, for example, stopped by running up against the coins in front of them, while the rotary plate continues to turn slightly. This produces a tailback of the already individually separated coins 86*a* to 86*b*. It is possible in this case that larger coins are displaced by neighboring smaller coins away from the outer guide ring 74 toward the center of the rotary plate 80.

Figure 14:
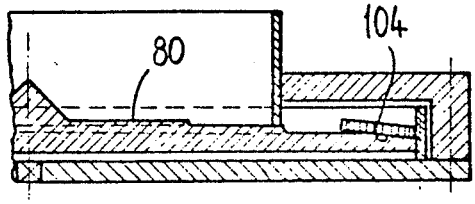
FIG. 14 shows a design variation of FIG. 13.

The deficiency mentioned above can be eliminated by a downwardly sloped bevel 104 of the outer rim of the rotary plate 80 according to FIG. 14. Such a bevel makes up for the insufficient centrifugal force before the rotary plate has reached its full speed during start-up.

The height limitation of the discharge channel 30, which can be seen for example in FIG. 2, is not absolutely necessary. However, the height must be limited in the region of the outlet opening 28 (FIG. 1) in order to prevent an accumulation of coins in this important area for individual separation. It is not necessary, however, to limit the height to twice the coin thickness. The rolling at the roll-off lug 38 ensures an individual separation of coins lying one on top of the other.

If, however, for a special reason, an embodiment is chosen in which the clear width of the outlet opening is greater than the smallest coin intended for individual separation (so that this smallest coin is not rolled around the roll-off lug 38), suitable measures must be taken in order to ensure that all coins in the region of the second deflection roller 46 of the conveyor belt 40 lie against the guide rail 54. For this purpose, the conveyor belt 40 may, for example, run at an acute angle toward the guide rail 54, or it may also be slanted.

Although various minor changes and modifications might be proposed by those skilled in the art, it will be understood that I wish to include within the claims of the patent warranted hereon all such changes and modifications as reasonably come within my contribution to the art.

I claim as my invention:

1. An apparatus for individual separation of disk-shaped items, comprising:

a drivable rotary plate having a central region for receiving the disk-shaped items directed thereon, and a fixed guide ring surrounding the central region in a fixed position above the rotating plate;

an outlet opening at which the items can move outwardly of the guide ring;

a discharge channel arranged in conjunction with the fixed guide ring, said discharge channel being arranged ahead of the outlet opening relative to a direction of rotation of the rotary plate;

said outlet opening being limited by and defining a distance between an innermost point of an outer limiting element and an outermost point of an inner limiting element, said distance defining a passage width at least as large as a diameter of a largest of the items intended for individual separation;

conveying means having one end extending into the outlet opening between said outer and inner limiting elements for acting from above on items delivered to the outlet opening in order to convey the delivered items through and away from the outlet opening along a guide means, said one end of the conveying means acting on the items to roll them around the inner limiting element when conveying them outwardly through the outlet opening;

a longitudinal extent of said conveying means being aligned with said discharge channel and having a conveying direction extending substantially tangential to the discharge channel, said inner limiting element being offset relative to said outer limiting element in said conveying direction of said conveying means; and the inner limiting element being arranged radially offset in relation to the outer limiting element such that a clear width corresponding to this offset is smaller than said passage width.

2. An apparatus according to claim 1 wherein said clear width is chosen to determine which disk-shaped items are to be rolled at said inner limiting element to be delivered through and away from the outlet opening.

3. An apparatus according to claim 1 wherein said clear width is smaller than a diameter of a smallest one of said disk-shaped items to be delivered through and away from the outlet opening.

4. An apparatus according to claim 1 wherein said conveying means has a conveying member which operates at a conveying speed greater than a circumferential speed of said rotary plate in said region of the discharge channel.

5. An apparatus according to claim 1 wherein the conveying means comprises a conveyor belt circulating around at least two deflection rollers, said conveyor belt extending into the discharge channel in a region of the outlet opening and positioned to act from above such that its lower side acts on the delivered items at the outlet opening.

6. An apparatus according to claim 1 wherein said inner limiting element is a roll-off lug positioned to limit the discharge channel in a circumferential direction of the plate.

7. An apparatus according to claim 1 wherein the discharge channel has a cover, an inner surface of the cover defines a clear height of the discharge channel, and the inner surface is roughened.

8. An apparatus according to claim 1 wherein at least a portion of a region of the outlet opening is covered by a web connected to the guide ring, and a clear height of the web relative to a surface of the rotary plate corresponds to a clear height of the discharge channel.

9. An apparatus according to claim 1 wherein said conveying means comprises a conveyor belt, a first deflection roller for deriving the conveyor belt being mounted directly at the outlet opening above the rotary plate and a pivotable arm, and means being provided to pre-load the pivotal arm in a direction of the rotary plate.

10. An apparatus according to claim 1 wherein the rotary plate has elevation means at the central region for causing disks deposited at the central region to spread out toward the fixed guide ring.

11. An apparatus according to claim 1 wherein a roll means is positioned at an outlet of the discharge channel to limit a height of the discharge channel, said roll means being driven such that its underside rotates toward a center of the rotary plate, a longitudinal axis of said roll means being positioned tangentially with respect to the rotary plate ahead of the outlet opening and bridges the discharge channel in a region ahead of the outlet opening.

12. An apparatus according to claim 11 wherein said roll means has a setting height slightly higher than the thickest item intended for individual separation.

13. An apparatus according to claim 1 wherein the guide ring is outwardly surrounded concentrically with a radially spaced additional guide ring, the rotary plate having an outer periphery extending beyond a diameter of the additional guide ring, and wherein the guide means associated with the conveying means guides the disk-shaped items into an outer region of the rotary plate lying between the two guide rings, and wherein the additional guide ring has an additional outlet opening.

14. An apparatus according to claim 13 wherein an additional conveying means is positioned at said additional outlet opening and extends approximately tangentially with respect to an outer rim of the rotary plate.

15. An apparatus according to claim 14 wherein the additional conveying means is offset by an angle of substantially 90° with respect to the conveying means associated with the outlet opening at the inner guide ring.

16. An apparatus according to claim 1 wherein the rotary plate is bevelled radially downwards at an outer rim.

17. An apparatus according to claim 1 wherein the disk-shaped items are coins.

18. An apparatus according to claim 1 wherein the conveying means in combination with the inner and outer limiting elements causes the disk-shaped items to be conveyed through the outlet opening along an "S"-shaped path.

19. An apparatus according to claim 1 wherein said discharge channel extends over a part of a circumference of the guide ring, said discharge channel including an outer guide surface and a cover defining a clear height with respect to an upper surface of the rotary plate which corresponds to a thickest item intended for individual separation, and wherein a peripheral edge of the rotary plate extends at least into a region of said guide surface.

20. An apparatus for individual separation of disk-shaped items, comprising:

a drivable rotary plate having means thereon for receiving the disk-shaped items directed onto at least a portion of a central region of the rotary plate, and a fixed guide ring surrounding the central region;

an outlet opening at which the items can move outwardly of the guide ring;

a discharge channel arranged inconjunction with the guide ring, said discharge channel being arranged ahead of the outlet opening relative to a direction of rotation of the plate;

conveying means extending into a region of the outlet opening for acting from above on items delivered to the outlet opening in order to convey the delivered items through and away from the outlet opening along a guide means;

said outlet opening being limited by an outer limiting element and an inner limiting element, a distance between the outer and inner limiting elements defining a passage width at least as large as a diameter of a largest of the items intended for individual separation;

said conveying means having a conveying direction extending substantially tangential to the discharge channel;

the inner limiting element being arranged radially offset in relation to the outer limiting element such that a clear width corresponding to this offset when viewed in the conveying direction is smaller than said passage width;

said discharge channel extending over a pair of a circumference of the guide ring, said discharge channel including an outer guide surface and a cover defining a clear height with respect to an upper surface of the rotary plate which corresponds to a thickest item intended for individual separation, and wherein a peripheral edge of the rotary plate extends at least beyond said guide surface; and the rotary plate having at its periphery a step region, a width of which is smaller in a radial direction within the discharge channel than a diameter of the smallest item intended for individual separation.

21. An apparatus for individual separation of disk-shaped items, comprising:

a drivable rotary plate having a central region for receiving the disk-shaped items directed thereon, and a fixed guide ring surrounding the central region in a fixed position above the rotating plate;

an outlet opening at which the items can move outwardly of the guide ring;

a discharge channel arranged in conjunction with the fixed guide ring, said discharge channel being arranged ahead of the outlet opening relative to a direction of rotation of the rotary plate;

said outlet opening being limited by and defining a distance between an innermost point of an outer limiting element and an outermost point of an inner limiting element, said distance defining a passage width at least as large as a diameter of a largest of the items intended for individual separation;

conveying means having one end extending into the outlet opening between said outer and inner limiting elements for acting from above on items delivered to the outlet opening in order to convey the delivered items through and away from the outlet opening along a guide means, said one end of the conveying means acting on the items to roll them around the inner limiting element when conveying them outwardly through the outlet opening;

a longitudinal extent of said conveying means being aligned with said discharge channel and having a conveying direction extending substantially tangential to the discharge channel, said inner limiting element being offset relative to said outer limiting element in said conveying direction of said conveying means;

the inner limiting element being arranged radially offset in relation to the outer limiting elment such that a clear width corresponding to this offset is smaller than said passage width; and said discharge channel extending over a part of a circumference of the guide ring, said discharge channel including an outer guide surface and a cover defining a clear height with respect to an upper surface of the rotary plate which corresponds to a thickest item intended for individual separation, and wherein a peripheral edge of the rotary plate extends at least into a region of said guide surface.

* * * * *